US006626354B1

(12) United States Patent
Baitz et al.

(10) Patent No.: US 6,626,354 B1
(45) Date of Patent: Sep. 30, 2003

(54) CASH-BOX SYSTEM WITH SENSOR

(75) Inventors: Günter Baitz, Berlin (DE); Hartmut Kamin, Berlin (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 09/786,311

(22) PCT Filed: Jul. 26, 1999

(86) PCT No.: PCT/DE99/02290

§ 371 (c)(1),
(2), (4) Date: Mar. 2, 2001

(87) PCT Pub. No.: WO00/14690

PCT Pub. Date: Mar. 16, 2000

(30) Foreign Application Priority Data

Sep. 2, 1998 (DE) ..... 198 39 977

(51) Int. Cl.[7] ..... G07G 1/00

(52) U.S. Cl. ..... 235/7 R; 235/10; 235/379; 902/9

(58) Field of Search ..... 235/379, 375, 235/7 R, 22, 381, 383, 10; 902/5, 27, 9

(56) References Cited

U.S. PATENT DOCUMENTS 4,337,393 A * 6/1982 Hilton ..... 235/487
4,992,648 A * 2/1991 Hutchison ..... 235/379
5,380,990 A * 1/1995 Baitz et al. ..... 235/7 R

* cited by examiner

*Primary Examiner*—Karl D. Frech
(74) *Attorney, Agent, or Firm*—McCormick, Paulding & Huber LLP

(57) ABSTRACT

Cashbox arrangement, having a transportable cashbox (10) and a fixed base plate (20), to which the cashbox (10) can be locked, and having a bolt (30) in the interior of the cashbox (10) which can be unlocked only when the cashbox lid (18) is open. Arranged in the cashbox (10) is a sensor (34), which registers the unlocking and/or the removal of the cashbox (10) from the base plate (20) and reports an information signal to a monitoring device via a signal path.

11 Claims, 2 Drawing Sheets

CASH-BOX SYSTEM WITH SENSOR

Figure 1:
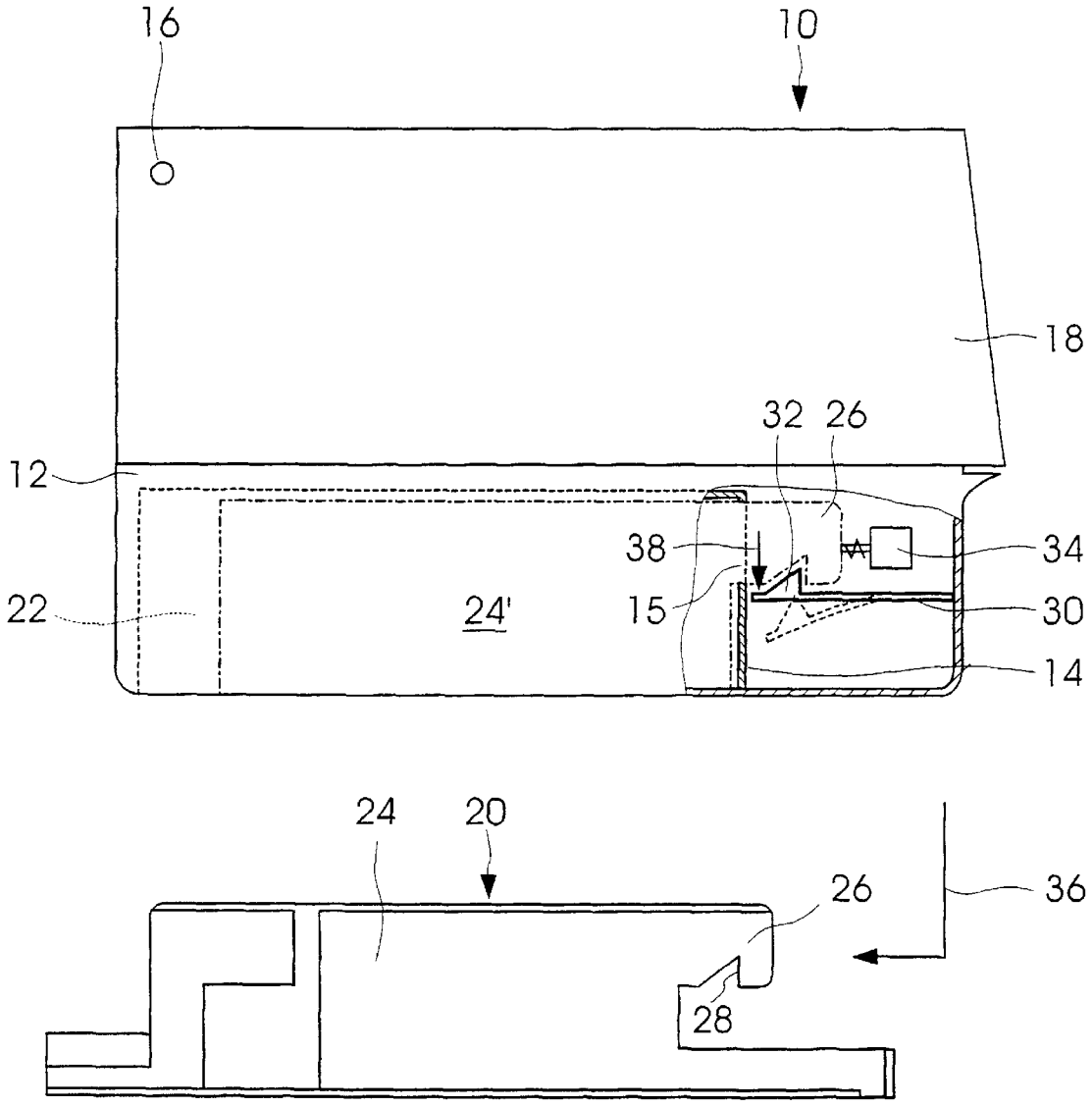

The invention relates to a cashbox arrangement according to the preamble of claim 1.

A cashbox arrangement of the said type, having a transportable cash-register controlled cashbox is disclosed by EP 0 560 292 B1. The cashbox can be placed onto a stationary base plate and locked to it. Arranged on the base plate is a retaining projection which, when the cashbox is placed on it, reaches through a slot in its base plate and latches with a bolt in the interior of the cashbox. For the purpose of unlocking, an unlocking element which is accessible only when the cashbox lid is open is operated manually. The opening of the lid is triggered by an electrical signal output by a cash register. Since such a cashbox must also be detachable from the base plate in the event of failure of the cash register or of the power supply, a so-called emergency unlocking means, which can be operated manually, is provided at a hidden point on the cashbox which cannot be seen by a customer. The hidden arrangement of this emergency unlocking means is, however, a protection against manipulations on the cashbox, such as unwarranted opening or unauthorized removal from the base plate, only as long as the constructional design of the cashbox arrangement is unknown.

WO 95/21420 A1 discloses an arrangement for the electronic marking of articles. This is used for marking the prices of articles offered for sale in particular in the racks of a department store. It comprises a central station, which transmits article information wirelessly as a radio transmission, and a multiplicity of product labels with a receiver for these radio transmissions. The product label disclosed by WO 95/21420 A1 also contains a transmitter, which is able to transmit information in response to a request signal.

It is an object of the invention to increase the security of cashboxes against unwarranted access.

For a cashbox arrangement of the type described at the beginning, the object is achieved by the characterizing features of claim 1.

The invention is based on the idea that specific preconditions have to be met before a cashbox can be permitted to be released from the base plate. A cashier, when starting work, is given a cashbox which he or she places onto the base plate at his or her cash desk and then, by entering his or her user number via a keyboard, or with the aid of an electronically readable pass, logs into a data processing device controlling the cash register.

Before any permissible removal of the cashbox, the cashier logs off from the data processing device. If, however, the cashbox is detached from the base plate with the cashier logged on, this is an indication of an attempt at manipulation, in response to which an alarm can be triggered. Particularly simple and nevertheless reliable reporting of manipulations on the cashbox is achieved in that in the cashbox there is arranged a sensor, which registers the unlocking and/or the removal of the cashbox from the base plate, and reports an information signal to a monitoring device via a signal path. The arrangement of the sensor within the cashbox makes the blocking of the sensor, performed with fraudulent intent, virtually impossible. Such blocking is in particular ineffective if the switching states and switching changes of the sensor before and as the cashbox is placed onto the base plate, and/or the logging-on and logging-off procedure of the cashier are evaluated in the monitoring device in order to trigger an alarm.

The sensor preferably monitors the position of the cashbox, corresponding to the locked position, with respect to the base plate and/or the position of the retaining projection in its position latched in the cashbox.

The sensor can be designed as an electrical switch, in particular as a microswitch, whose operating element projects into the displacement path of the retaining projection. As an alternative to this, the sensor can be a light barrier registering the position of the retaining projection or a capacitive or inductive proximity switch, which senses its distance from the retaining projection or from the base plate.

The transmission of the information signal is in the simplest case routed via a line carrying an operating signal for unlocking the cashbox lid. This renders additional electrical installations superfluous.

According to a preferred embodiment of the invention, the sensor is connected to a transmitter or transmitter/receiver which is located in the cashbox and whose output signal, as an information signal, is routed via a wireless signal path.

For this purpose, the transmitter or transmitter/receiver can be incorporated into a wireless LAN network, via which the information signal is routed to the monitoring device. Such LAN networks are frequently used in any case, particularly in cash desk installations with many cash registers, in order to connect the cash registers to a central computer. The incorporation of the transmitter or transmitter/receiver therefore does not entail any additional expenditure for the signal transmission. A wireless LAN network is constructed either as an infrared or radio LAN, so that the transmitter or transmitter/receiver in the cashbox must be constructed appropriately.

The transmitter or transmitter/receiver used can also be an electronic product label incorporated into an arrangement for electronic article marking, as disclosed by WO 95/21420 A1. The known product label also contains a transmitter, which is able to transmit information in response to a request signal. Such a product label can be fitted in or on the cashbox with simple means, and the sensor can be connected to its signal input. If the information signal from the sensor is provided as a request signal to the signal input of the product label, then its transmission channel can be used as a wireless signal path.

A product label of the said type is available as a mass-produced item and has its own power supply. The incorporation of the transmitter or transmitter/receiver of a product label fitted in or on the cashbox into the arrangement for electronic article marking therefore does not signify any additional outlay. A further advantage of the use of an electronic product label is that its indicating device, which is present in any case, can be used to indicate information transmitted to the cashier by the monitoring device, for example a warning about a thief who is in the store.

Figure 2:
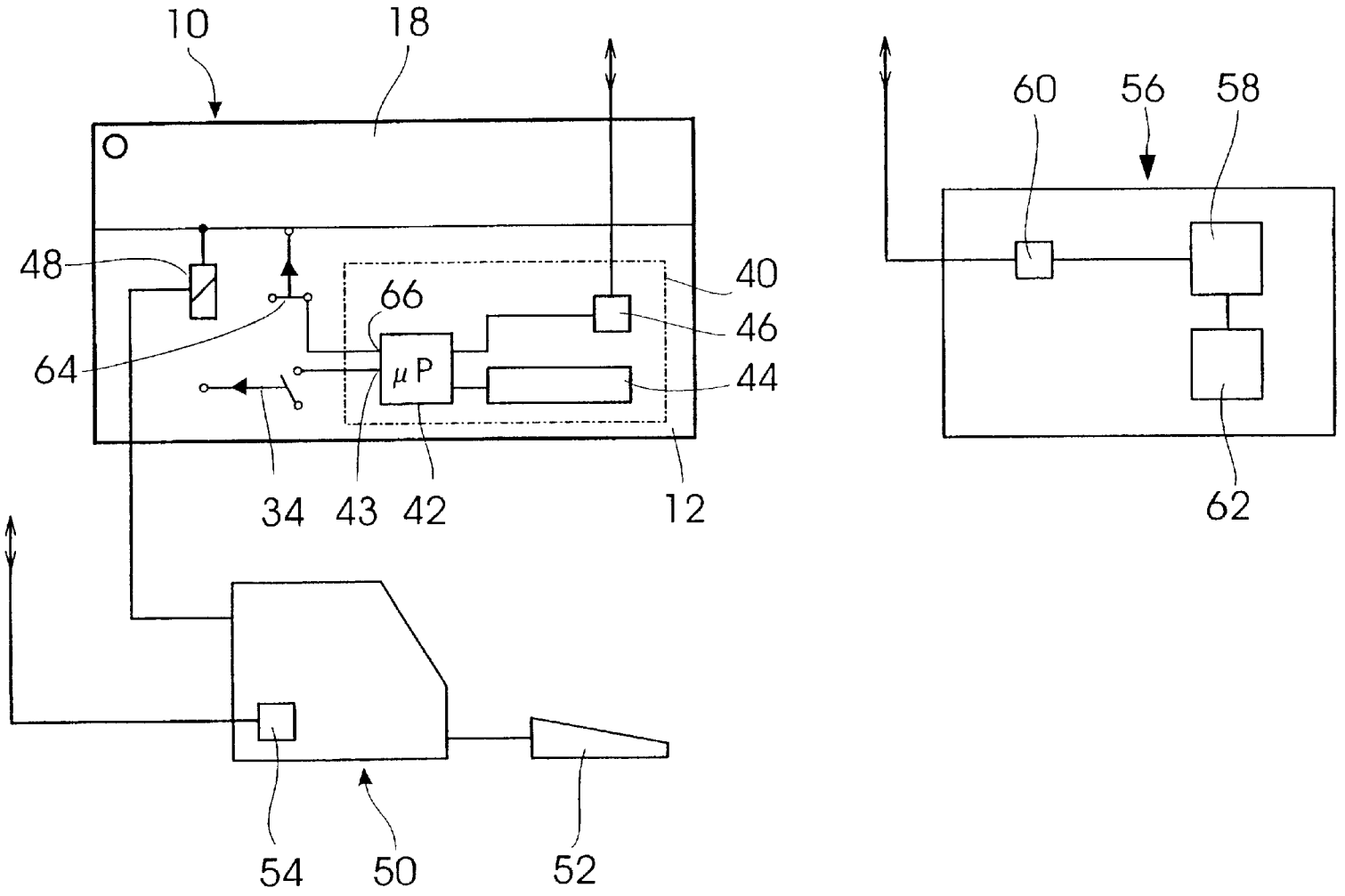

In the following text, an exemplary embodiment of the invention will be explained using the appended drawing, in which:

FIG. 1 shows a cashbox and a base plate onto which the cashbox can be placed, FIG. 2 shows a schematic illustration of a cash register arrangement and a block diagram thereof.

A cashbox 10 shown in FIG. 1 substantially comprises a lower cashbox part 12 and a cashbox lid 18 which is arranged such that it can be pivoted about a horizontal axis 16 on the lower cashbox part 12. An opening 15 is integrally molded into a wall 14 which closes off the lower cashbox part 12 from the outside.

The cashbox 10 can be transported independently of a cash register 50 illustrated in FIG. 2. For its operational use, it is placed onto a base plate 20, for example arranged at a fixed location at a cash desk. The lower cashbox part 12 has on its underside a recess 22, which is able to accommodate a functional subassembly 24 arranged on the base plate 20. On its side facing the front side of the cashbox 10, the recess 22 is bounded by the wall 14. The functional subassembly comprises a retaining projection 26 having a latching recess 28 and an electromagnet 48 which is shown in FIG. 2 and, in order to unlock the cashbox lid 18, can be driven by means of an electrical operating signal output, for example, by the cash register 50.

Arranged in the interior of the lower cashbox part 12 is a bolt 30 with a mating latch 32 intended to engage in the latching recess 28. Also located in the lower cashbox part 12 is a switching element 34, which is operated by the retaining projection 26 arranged on the base plate 20, as will be described further below.

FIG. 2 shows, in a schematic illustration, a cash register arrangement and a block diagram thereof. The cashbox 10 and the base plate 20, both described by FIG. 1, are parts of the cash register arrangement.

Recurring parts bear the same reference symbols. Fitted in the cashbox 10 or on its outside, preferably on the outside of the cashbox lid 18, is a product label 40, as disclosed by WO 95/21420 A1. The arrangement of the product label 40 on the cashbox lid 18 has the advantage that its indicating device 44 is always in the field of view of the cashier. The product label 40 comprises a product-label processor 42, to whose signal input 43 the switching element 34 is connected. In addition, the indicating device 44 and a first wireless bidirectional signal transmission device 46 are connected to the product-label processor 42. The electromagnet 48 which releases the cashbox lid 18 is connected to an interface circuit (not illustrated) in the cash register 50, it being possible for the latter to be operated from a cash-register keyboard 52.

Incorporated into the cashbox 10 is a further switching element 64 which, when the cashbox lid 18 is unlocked and opened, is located in its open position and, as a result of closing the cashbox lid 18, is brought by the latter into its closed position. The further switching element 64 is connected to a second input 66 of the product-label processor 42.

Incorporated into the cash register 50 is a second signal transmission device 54. The cash register arrangement further comprises a central station 56 having a central computer 58, which is connected together with a third signal transmission device 60 and a central monitoring device 62.

In order to connect the cashbox 10 to the base plate 20, the cashbox 10 is placed onto the base plate 20 from above and then pushed rearward counter to the force of a spring (not illustrated), as indicated by the movement arrow 36. As it is put into place, the functional subassembly 24 engages in the recess 22 and, as the cashbox 10 is displaced, slides rearward into the position 24' shown dash-dotted, the retaining projection 26 passing through the opening 15 into the interior of the lower cashbox part 12. At the same time, the bolt 30 is deflected by the retaining projection 26 into its position shown dashed and finally latches with its mating latch 32 into the latching recess 28.

As the cashbox 10 is displaced rearward, the retaining projection 26 operates the switching element 36, which then outputs an information signal "cashbox in operating position". This signal is transmitted via the first signal transmission device 46, the third signal transmission device 60 and the central computer 58 to the monitoring device 62. The cashier then enters his or her user number into the cash register 50 via the cash-register keyboard 52 or with the aid of an electronically readable pass (not illustrated), and therefore logs into the monitoring device 62 via the second signal transmission device 54, the third signal transmission device 60 and the central computer 58. The monitoring device 62 is then switched to "active".

Before the cashbox 10 is released from the base plate 20, the cashier logs off from the monitoring device 62 by means of an appropriate entry on the cash-register keyboard 52. This information is transmitted via the same transmission path as the cashier log-on. The cashbox lid 18 is then opened by the electrical operating signal output to the electromagnet 48 by the cash register 50. This makes the bolt 30 accessible. This is then pressed manually downward, in the direction of the arrow 38, into its position shown dashed, the latching with the latching recess 28 being canceled. The switching element 34 outputs an information signal "cashbox out of operating position" to the monitoring device 62, but the latter expects this message and does not trigger an alarm. The spring then pushes the cashbox 10 forward, so that the latter can be taken upward off the base plate 20.

This is similarly true of the operational opening of the cashbox lid 18 during a cash-registering operation. The conclusion of each transaction is reported to the monitoring device 62 by the cash register 50. The cash register 50 then sends an operating signal to the electromagnet 48, the cashbox lid 18 is unlocked and the further switching element outputs an information signal "cashbox opened" to the monitoring device 62, which has been expecting this information signal within a specific time period and therefore does not trigger an alarm.

If the cashbox 10 is released from the base plate 20 with the cashier logged in, the switching element 34 outputs the information signal "cashbox out of operating position" to the monitoring device 62, which then triggers an alarm. If the cashbox lid 18 is opened without any previous information about the conclusion of a transaction, the alarm will likewise be triggered.

What is claimed is:

1. A cashbox arrangement, comprising a transportable cashbox (10) with a lower cashbox part (12) and a cashbox lid (18) and a fixed base plate (20), to which the cashbox (10) can be locked, for which purpose the base plate (20) has a retaining projection (26) which, when the cashbox (10) is placed onto the base plate (20), reaches through an opening (15) in a wall (14) of the lower cashbox part (12) and latches with a bolt (30) in the interior of the cashbox (10), it being possible for the bolt (30) to be unlocked only when the cashbox lid (18) is open, characterized in that there is arranged in the cashbox (10) a sensor (34), which registers the unlocking and/or the removal of the cashbox (10) from the base plate (20), and in that the sensor (34) is connected to a transmitter or transmitter/receiver (46) which is located in the cashbox (10) and transmits an information signal to a monitoring device (62) via a wireless signal path (43, 42, 46, 60, 58).

2. The cashbox arrangement as claimed in claim 1, characterized in that a further sensor (64), which registers the unlocking and/or the opening of the cashbox lid, is connected to the transmitter or transmitter/receiver (46), which transmits a further information signal to the monitoring device (62).

3. The cashbox arrangement as claimed in claim 1, characterized in that the information signal or else the further information signal is routed to the monitoring device (62) via a wireless LAN network.

4. The cashbox arrangement as claimed in claim 1, characterized in that the transmitter or transmitter/receiver used is a signal transmission device (4*b*) of an electronic product label (40) known per se, which is fitted in or on the cashbox (10) and to whose signal input the sensor (34) or else the further sensor (64) is connected.

5. The cashbox arrangement as claimed in claim 1, characterized in that the sensor (34) monitors the position of the cashbox (10), corresponding to the locked position, with respect to the base plate (20), and/or the position of the retaining projection (26) in its position latched in the cashbox (10).

6. The cashbox arrangement as claimed in claim 1, characterized in that the sensor is an electrical switching element (34), in particular a microswitch, whose operating element projects into the displacement path of the retaining projection (26).

7. The cashbox arrangement as claimed in claim 1, characterized in that the sensor is a light barrier that registers the position of the retaining projection (26).

8. The cashbox arrangement as claimed in claim 1, characterized in that the sensor is a capacitive or inductive proximity switch, which senses its distance from the retaining projection (26) or from the base plate (20).

9. The cashbox arrangement as claimed in claim 2, characterized in that the further sensor is designed as a switching element (64), in particular as a microswitch, or as a light barrier or as a capacitive or inductive proximity switch.

10. The cashbox arrangement as claimed in claim 1, characterized in that the switching states and/or switching changes of the sensor (34) before and as the cashbox (10) is placed onto the base plate (20), or else those of the further sensor (64) and/or a logging-in or logging-off procedure of a cashier are evaluated in the monitoring device (62) in order to trigger an alarm.

11. A cashbox arrangement, comprising a transportable cashbox (10) with a lower cashbox part (12) and a cashbox lid (18) and a fixed base plate (20), to which the cashbox (10) can be locked, for which purpose the base plate (20) has a retaining projection (26) which, when the cashbox (10) is placed onto the base plate (20), reaches through an opening (15) in a wall (14) of the lower cashbox part (12) and latches with a bolt (30) in the interior of the cashbox (10), it being possible for the bolt (30) to be unlocked only when the cashbox lid (18) is open, characterized in that there is arranged in the cashbox (10) a sensor (34), which, registers the unlocking and/or the removal of the cashbox (10) from the base plate (20) and outputs an information signal, and in that in the cashbox (10) there is additionally arranged a further sensor (64) which registers the unlocking and/or the opening of the cashbox lid and outputs a further information signal, and in that the information signal or else the further information signal is routed to a monitoring device (62) via a line carrying an operating signal for unlocking the cashbox lid (18).

* * * * *